US007228721B2

(12) United States Patent
Clark

(10) Patent No.: US 7,228,721 B2
(45) Date of Patent: Jun. 12, 2007

(54) PIVOT LINK FOR SHEET BENDING BRAKE AND SHEET BENDING BRAKE INCLUDING PIVOT LINK

(75) Inventor: Michael C. Clark, Columbiaville, MI (US)

(73) Assignee: Tapco International Corporation, Wixom, MI (US)

( * ) Notice: Subject to any disclaimer, the term of this patent is extended or adjusted under 35 U.S.C. 154(b) by 0 days.

(21) Appl. No.: 10/759,351

(22) Filed: Jan. 16, 2004

(65) Prior Publication Data

US 2004/0250592 A1 Dec. 16, 2004

Related U.S. Application Data

(60) Provisional application No. 60/440,676, filed on Jan. 17, 2003.

(51) Int. Cl.
*B21D 5/04* (2006.01)

(52) U.S. Cl. ..... 72/319; 74/520

(58) Field of Classification Search ..... 72/319, 72/450, 451; 269/228, 254 R, 254 CS; 81/379, 81/380; 74/522, 520
See application file for complete search history.

(56) References Cited

U.S. PATENT DOCUMENTS 1,852,180 A * 4/1932 McKnight et al. ..... 269/81
2,379,107 A * 6/1945 William ..... 81/356
3,490,309 A * 1/1970 Gustavson ..... 74/520
4,342,214 A 8/1982 Neuendorf
4,372,142 A * 2/1983 Rhoades ..... 72/319
4,411,150 A 10/1983 Klein et al.
4,445,356 A 5/1984 Chubb et al.
4,493,200 A 1/1985 Rhoades
4,583,391 A 4/1986 Stafford
4,732,032 A 3/1988 Kogure
4,768,367 A 9/1988 Favrin
4,918,966 A 4/1990 Raccioppi, Jr.
4,922,742 A 5/1990 Syrylo, Jr. et al.
5,526,672 A 6/1996 Cain et al.
5,572,901 A 11/1996 Wilhelm
5,630,336 A 5/1997 Jorgenson
5,761,939 A 6/1998 Spencer et al.
6,082,164 A 7/2000 Palmer
2002/0124621 A1 9/2002 Clark

* cited by examiner

*Primary Examiner*—Daniel C. Crane
(74) *Attorney, Agent, or Firm*—Howard & Howard Attorneys, P.C.

(57) ABSTRACT

A guide mechanism for use with a sheet bending brake has a clamping member having a lower leg extending therefrom, a pivot arm and a guide mechanism. The pivoting arm being pivotally supported by and extending from the clamping member to define a clamping area with the lower leg. The guide mechanism reacts between the clamping member and the pivoting arm for moving the pivoting arm between an open position and a closed position.

16 Claims, 7 Drawing Sheets

PIVOT LINK FOR SHEET BENDING BRAKE AND SHEET BENDING BRAKE INCLUDING PIVOT LINK

This application claims priority to U.S. Provisional Patent Application Ser. No. 60/440,676 filed Jan. 17, 2003.

FIELD OF THE INVENTION

The subject invention relates to a sheet bending brakes, and more particularly to a guide member reacting between a clamping member and a pivoting arm for moving the pivoting arm between the open and clamped positions.

BACKGROUND OF THE INVENTION

Various sheet bending brakes are known and used for bending and cutting metal or vinyl sheet work-pieces such as those used for siding on homes and buildings in the industry today. A typical sheet bending brake functions by clamping a work piece between clamping members and using a hinged bending arm to bend the work-piece about the clamping member.

A sheet bending brake disclosed in the United States Publication No. 2002/0124621 (the '0124621 publication) shows a guide mechanism reacting between a clamping member and a pivoting arm for moving the pivoting arm between the open position and the clamped position of the sheet bending brake. The guide mechanism includes a detent between the open and the clamped positions for providing an intermediate clamping position for adjusting the position of and precisely aligning the work piece. However, the clamping member disclosed in the '0124621 publication is not self-adjustable, but instead must be tuned as before.

Hence, the sheet bending brake disclosed in the '0124621 publication, although an improvement, did not overcome the inadequacies that characterize sheet bending brakes in the area of a need to manually tune the overall mechanism to accurately perform work functions on the work-piece as the sheet metal brake was used over a period of time. Accordingly, one of the opportunities of continuous development and research is the area of a more advanced design of a pivot link that may eliminate the need of manual adjustment and provide greater accuracy in using the sheet metal brake over time.

SUMMARY OF INVENTION

The subject invention provides pivot link for a sheet bending brake assembly for securing a work-piece, wherein the pivot link includes a body having top and bottom ends, and sidewalls. The bottom end of the pivot link has a pocket defined therewithin, and slots defined within the sidewalls of the bottom end and inwardly extending from the side walls to the center line and connected with the pocket. The pivot link includes a spring positioned within the pocket extending internally from the bottom end towards the top end and a bolt pivotably securing the bottom end within the pivoting arm. The bolt, slided through the slots, is positioned below the spring to keep the spring within the pocket. The bolt travels within the slots from a first to a second end, compressing and releasing the spring.

In the alternative embodiment of the present invention, the pivot link includes a bar, having a cylindrical shape and formed from a vulcanized rubber. The bar includes a cavity defined within one of the respective ends to receive a washer embedded within the cavity. The bar is positioned within the pocket extending internally from the bottom end towards the top end of the body.

The advantages of the present invention provides for a new design that is simpler to manufacture. The invention does not require the adjustment by the operator wherein thicker material can be placed in the brake and the spring or the bar positioned within the pivot link adjusts the link without need of the operator's help.

Accordingly, the pivot link shown in the present invention is new, efficient, and provides for an effective way to overcome the inadequacies of the related art sheet bending brakes.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Referring to the Figures, wherein like numerals indicate like or corresponding parts throughout the several views, a sheet bending brake assembly for securing a work piece is generally shown at 20.

Figure 1:
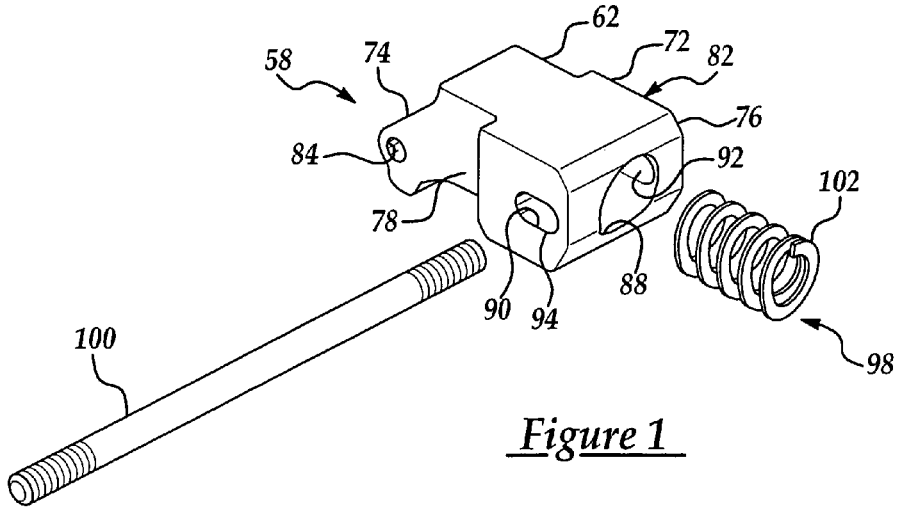
FIG. 1 is a perspective view of a pivot link assembly.
Figure 2:
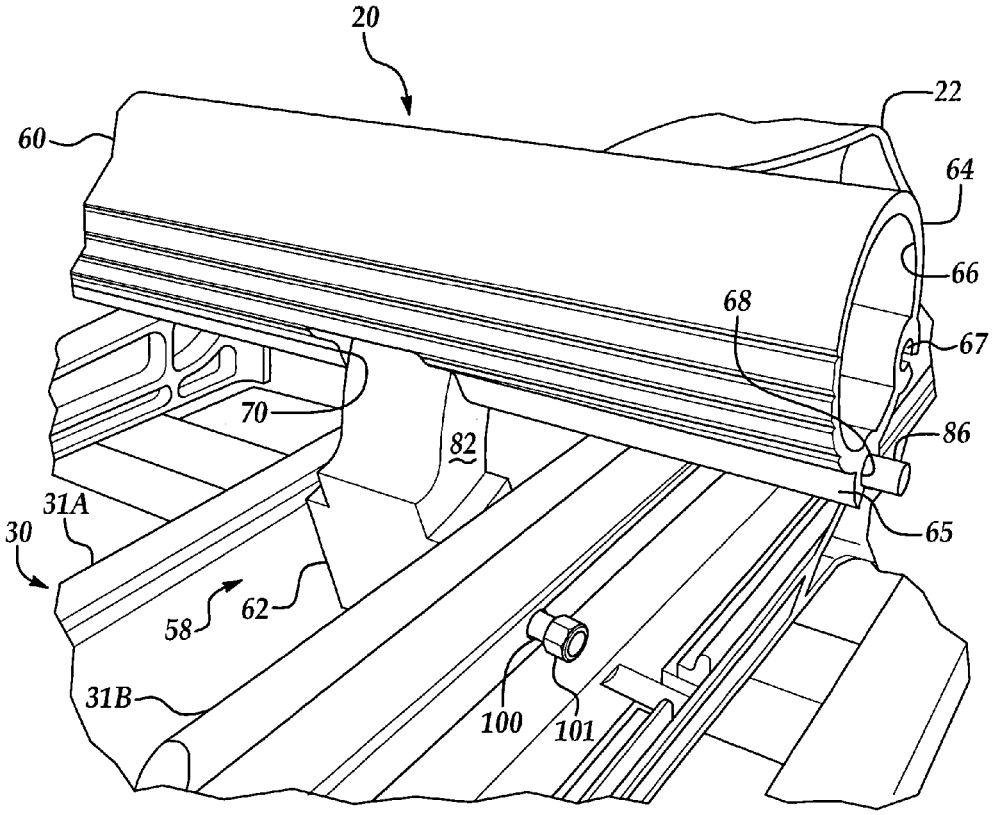
FIG. 2 is a perspective view of the pivot link connected with a handle in a close mode of operation of a sheet bending brake.
Figure 8:
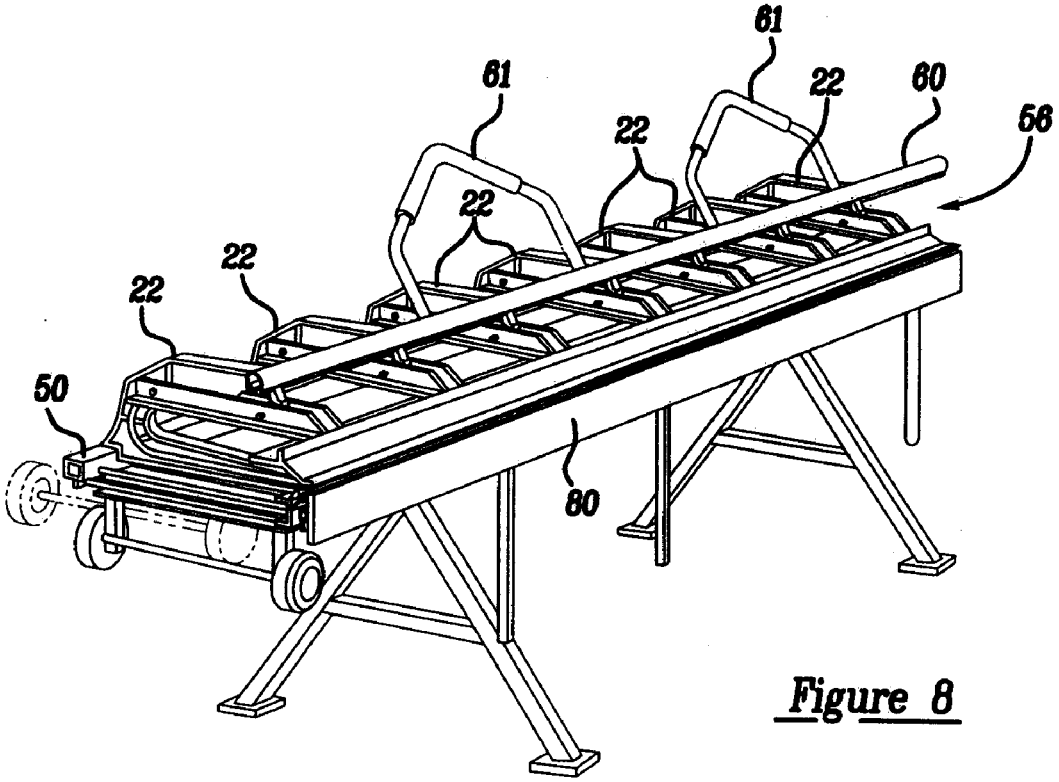
FIG. 8 is a perspective view of the sheet bending brake being closed.
Figure 9:
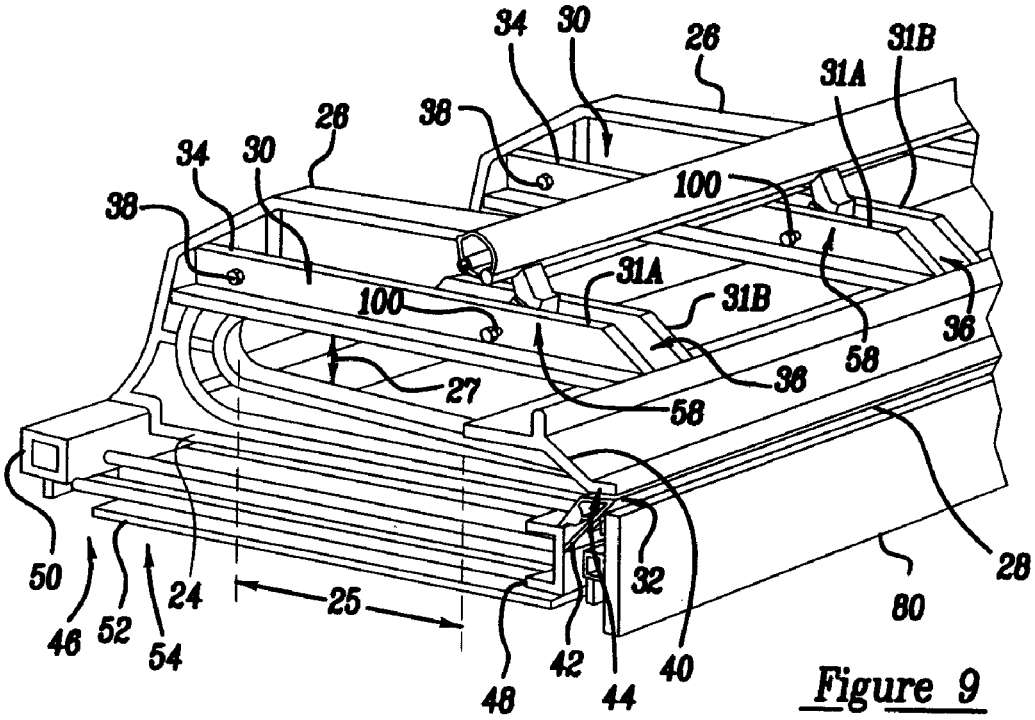
FIG. 9 is a perspective view of the sheet bending brake being opened.
Figure 10:
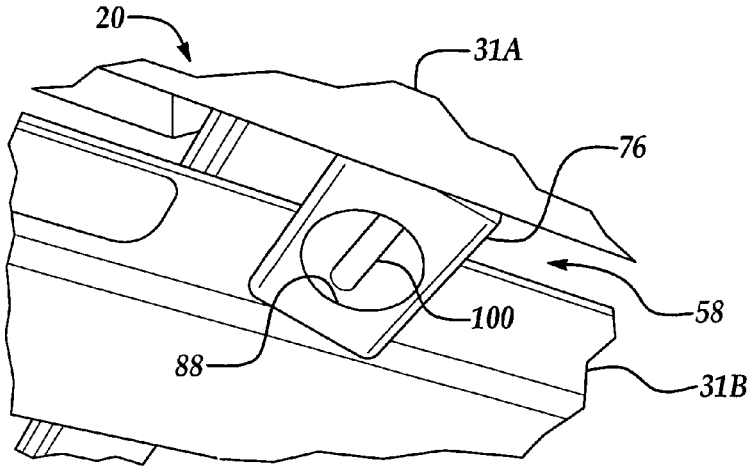
FIG. 10 is still another perspective view of the pivot link.
Figure 11:
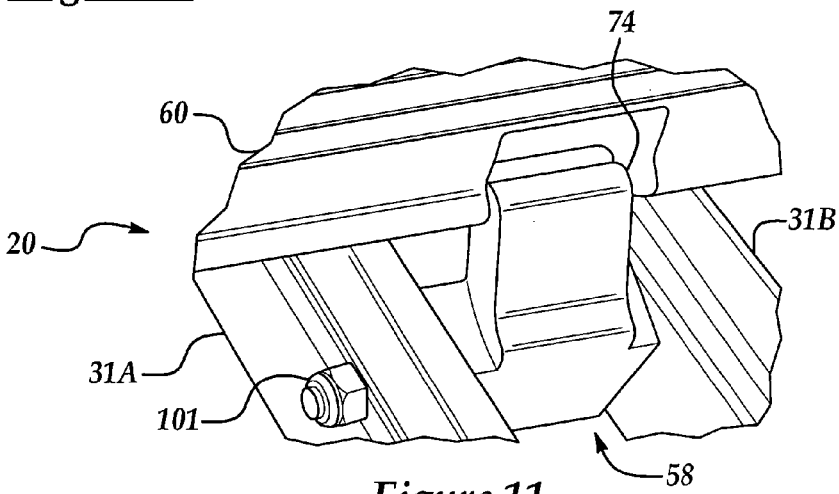
FIG. 11 is still another perspective view of the pivot link.
Figure 12:
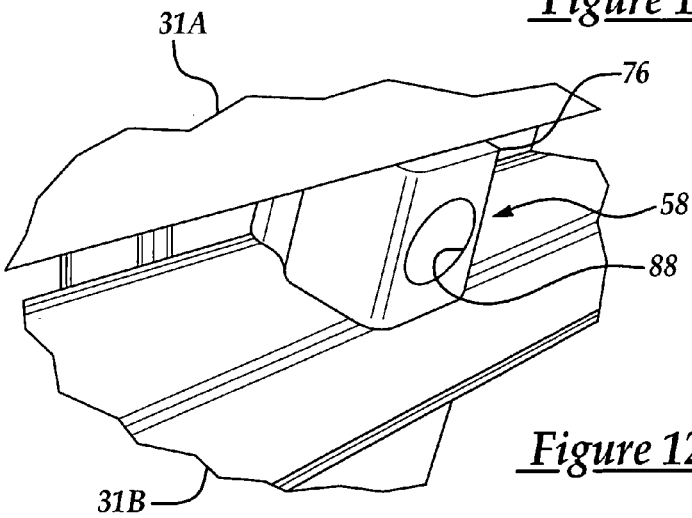
FIG. 12 is yet another perspective view of the pivot link.
Figure 13:
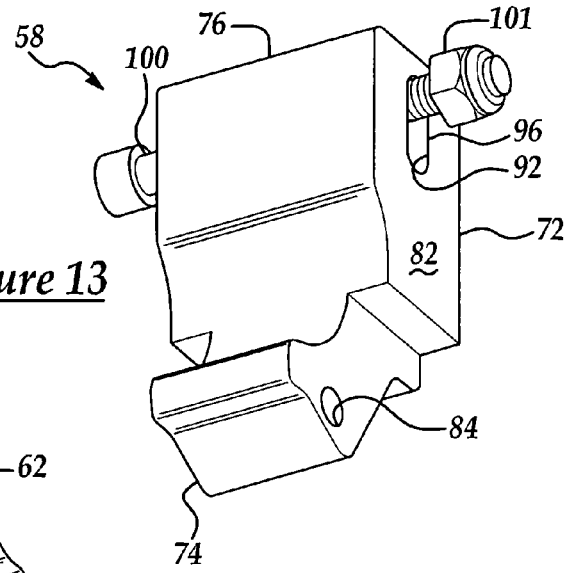
FIG. 13 is still another perspective view of the pivot link that shows a bolt positioned within the body of the pivot link.

With particular reference to FIGS. 2, 8 and 9, the sheet bending brake assembly 20 includes a clamping member 22 having a lower leg 24 extending therefrom. The clamping member 22 is generally a C-shaped frame member and has an upper leg 26 extending therefrom. As seen in FIG. 2, a plurality of longitudinally spaced clamping members 22 form the assembly 20 and allow for engaging differently sized work pieces, as will be described below. However it is to be understood that any number of clamping members 22 may be utilized with the subject invention. FIGS. 2–3 and 9–12 illustrate a single clamping member 22 that forms the sheet bending brake assembly 20. It should be appreciated that each of the frame members is substantially identical. Preferably, the clamping members 22 are made of light-weight aluminum to facilitate transportation of the sheet bending brake assembly 20. However, different materials may be utilized for providing additional support to the assembly 20 as is known in the art of sheet bending brakes.

A pivoting arm 30 is pivotally supported by and extends from the clamping member 22. The pivoting arm 30 defines a clamping area 32 with the lower leg 24. The clamping area 32 has a throat depth 25 and forms a working pocket 27. Designing the C-shaped frame member differently can alter both the throat depth 25 and working pocket 27. The pivoting arm 30 has a secured end 34 and a free end 36, such that a bolt 38 extends through the secured end 34 and into the clamping member 22. The pivoting arm 30 is moveable between an open position and a clamped position by pivoting about the bolt 38 while moving between the open position and the clamped position. In the illustrated embodiment, the pivoting arm 30 includes first and second arms 31A, 31B.

An upper clamping surface 40 is connected to the free end 36 of the pivoting arm 30 and a lower clamping surface 42 is connected to the lower leg 24. The upper clamping surface 40 and the lower clamping surface 42 engage one another in the clamped position to secure the work piece therebetween. The opening between the upper clamping surface 40 and the lower clamping surface 42 is commonly referred to as a mouth opening. After the work piece is secured, the upper and lower clamping surfaces 40, 42 create a bending surface 44 that the work piece is bent about. Additionally, the sheet bending brake assembly 20 may be used with a tool cutter (not shown) for cutting the work piece while in the clamped position. It is to be understood that many different tools known in the art of sheet bending brakes may be utilized with the subject invention.

Figure 4:
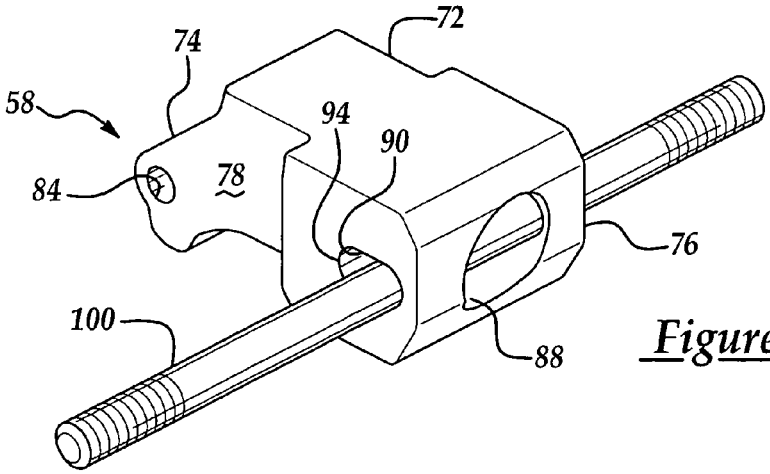
FIG. 4 is another perspective view of the pivot link assembly.
Figure 5:
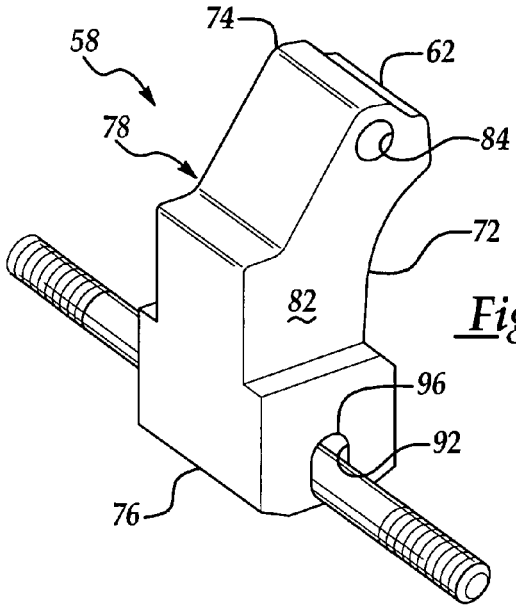
FIG. 5 is still another perspective view of the pivot link assembly.
Figure 6:
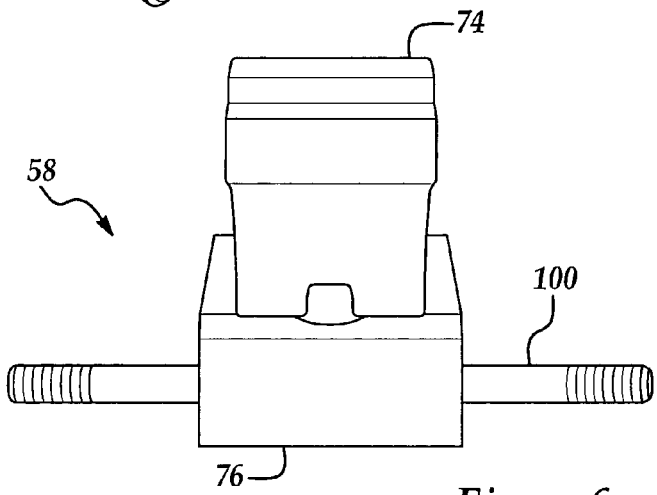
FIG. 6 is a side view of the pivot link assembly.
Figure 7:
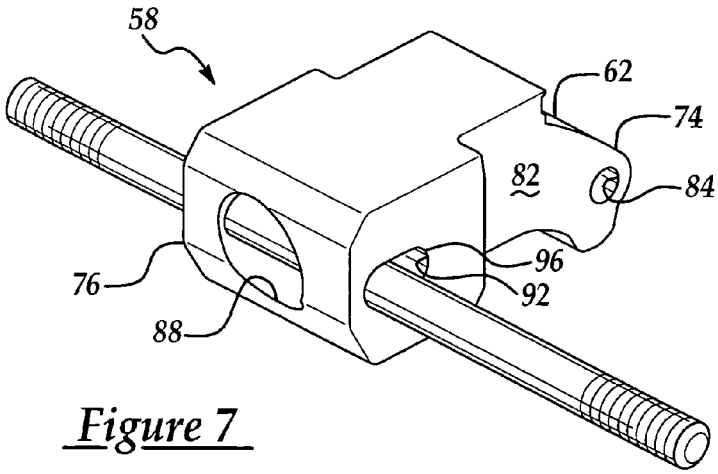
FIG. 7 is another perspective view of the pivot link assembly.

As shown in FIG. 4, a base 46 supports the clamping members 22 and provides support to the assembly 20 while moving the pivoting arm 30 between the open position and the clamped position. The base 46 includes a front rail 48 and a rear rail 50 defining a table 52 such that the clamping members 22 are supported by the front rail 48 and the rear rail 50. The table 52 has a first table end 54 and a second table end 56. The table 52 may be portable or may connected to a wheel mechanism (not shown).

The assembly 20 further includes a guide mechanism 58 reacting between the clamping member 22 and the pivoting arm 30 for moving the pivoting arm 30 between the open position and the clamped position.

Figure 3:
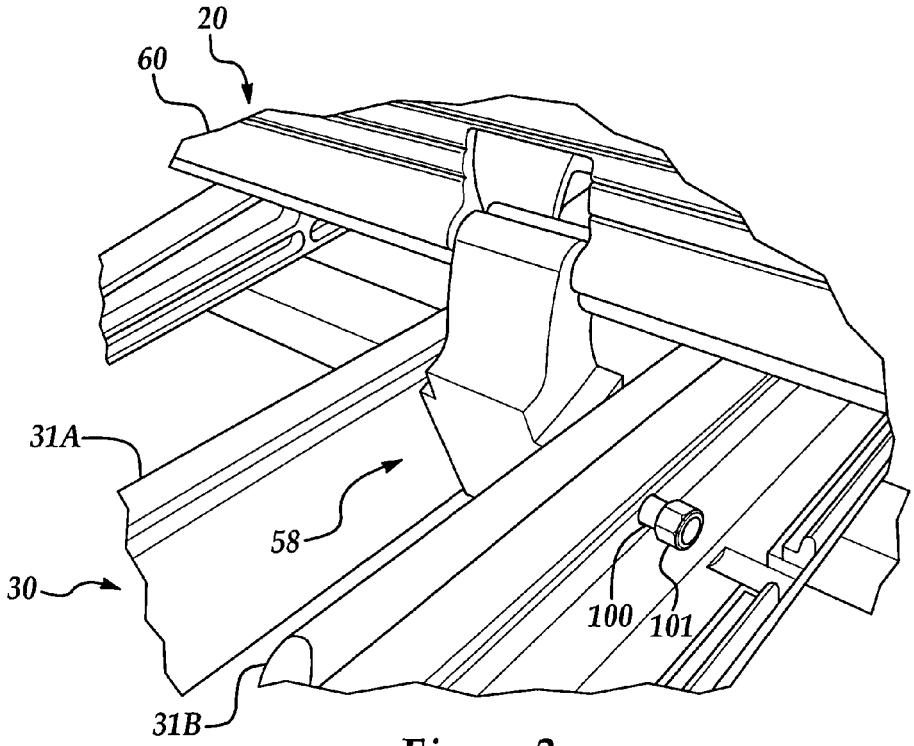
FIG. 3 is a perspective view of the pivot link connected with the handle in an open mode of operation of the sheet bending brake.

The guide mechanism 58 is coupled to a handle 60. The guide mechanism includes at least one pivot link 62. The handle 60 is rotatably coupled to the at least one pivot link 62. As best can be seen in FIGS. 2 and 3, the handle 60 extends from the guide mechanism 58 for facilitating movement of the pivoting arm 30 between the open and the clamped positions. The handle 60 can also be provided with a handle extension member 61, as shown, for example. The handle 60 functions to move the pivoting arm 30, thereby rotating the guide mechanism 58. The handle 60 may be a single lever for a single clamping member 22 or a long bar engaging the plurality of clamping members 22 as shown in FIG. 2. In the illustrated embodiment, the handle 60 includes an upper portion 64 and a lower portion 65. The grasping portion 67 has an internal bore 66. The lower portion 65 has a second internal bore 68 running the length of the handle 60 and one or more cutouts 70 which intersect the second internal bore 68 and accept the pivot link 62 (see below).

With reference to FIGS. 2 and 9, the handle 60 is also rotatably coupled to the clamping member or members 22. In the illustrated embodiment, the handle 60 includes another bore 65 which accepts a rod (not shown) inserted therethrough and through an aperture (not shown) in the clamping member(s) 22.

In operation, the handle 60 rotates the guide mechanism 58 about a pin 86, which causes the pivoting arm 30 to move between the open position and the clamped position.

Referring to FIG. 9, a bending arm 80 is supported by the clamping member for engaging the work piece and bending the work piece to a desired angle. The bending arm 80 extends the length of the sheet bending brake assembly 20 and contacts the work piece 28 when rotated. The bending arm 80 may be hingedly connected with the lower clamping surface 42. The bending arm 80 may also have extensions (not shown) extending from the bending arm 80 for allowing easy rotation of the bending arm 80.

The assembly 20 may further include a bend indicator (not shown) connected to the bending arm 80 for indicating a degree of rotation of the bending arm 80 during the bending of the work piece. The bend indicator (not shown) may include a displacement sensor (not shown) for measuring the degree of rotation of the bending arm 80 and a display device (not shown) for displaying the degree of rotation of the bending arm 80. The bend indicator may be any type of electrical or mechanical device capable of measuring a degree of rotation.

The pivot link 62 is positioned within the pivoting arm 30 between the first and second arms 31A, 31B. The pivoting arm 30 is moveable between an open position and a clamped position by pivoting about a bolt (not shown) while moving between the open position and the clamped position, as shown in FIGS. 2 and 3.

The pivot link 62 reacts between the clamping member 22, as shown in FIG. 2, and the pivoting arm 30 for moving the pivoting arm 30 between the open position and the clamped position. The pivot link 62 includes a body, generally indicated at 72, that further includes top and bottom ends 74,76, and side walls 78, 82. The top end 74 of the pivot link 62 includes a channel 84, defined therewithin to be pivotably connected within the handle 60 by a pin 86 inserted in the bore 68. The handle 60, as illustrated in FIGS. 2 and 3, functions to move the pivoting arm 30, thereby rotating the pivot link 62. The top portion of the sidewalls 78, 82 includes a distance therebetween less than the distance between the bottom portion of the side walls 78, 82.

The bottom end 74 of the pivot link 62, positioned within the pivoting arm 30 has a pocket 88 defined therewithin, and slots 90, 92, respectively, defined within the sidewalls 78, 82 of the bottom end. The slots 90, 92 further define first and second ends 94,96, respectively, and inwardly extend from the side walls 78,82 of the bottom end 76 to the center line and are connected with the pocket 88.

The pivot link 62 includes a spring mechanism 98 positioned within the pocket 88 extending internally from the bottom end 76 to the top end 74. The pivot link 62 includes a bolt or threaded rod 100 and at least one nut 101 pivotably securing the bottom end 76 of the pivot link body 72 within the pivoting arm 30. The bolt 100, slided through the slots 90,82, is positioned below the spring mechanism 98 to keep the spring mechanism 98 within the pocket 88. In the close mode of operation of a brake assembly, the bolt 100 travels within the slots 90, 92 from the first end 94 to the second end 96, compressing the spring mechanism 98. In the open mode of operation of the brake assembly 20, the bolt 98 travels from the second end 96 to the first end 94 releasing the spring mechanism 98 within the pocket 88. As illustrated in FIGS. 2 and 3, the bolt 100 that adjusts the spring mechanism 98 between the open and the clamped positions of the brake assembly 20 and makes the pivot link 62 self-adjustable that eliminates the need of adjustment by an operator.

As shown in FIGS. 1 and 3–7, in one embodiment the spring mechanism 98 includes a spring 102.

Figure 14:
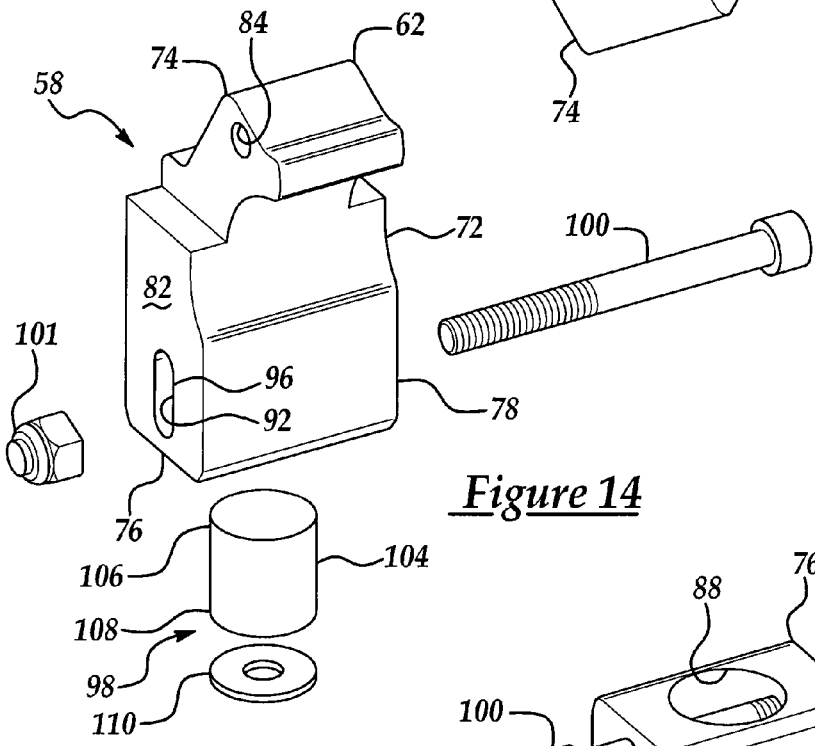
FIG. 14 is an exploded perspective view of an alternative embodiment of the pivot link featuring a rubber bar.
Figure 15:
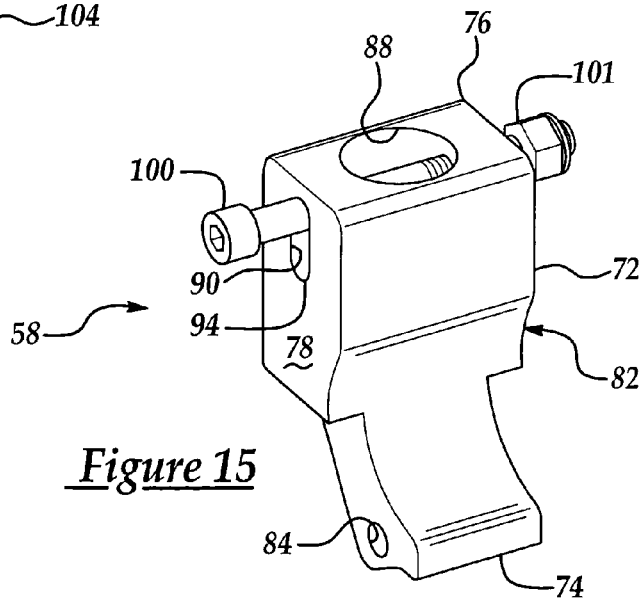
FIG. 15 is still another perspective view of the pivot link that shows the bolt positioned within the body of the pivot link.
Figure 16:
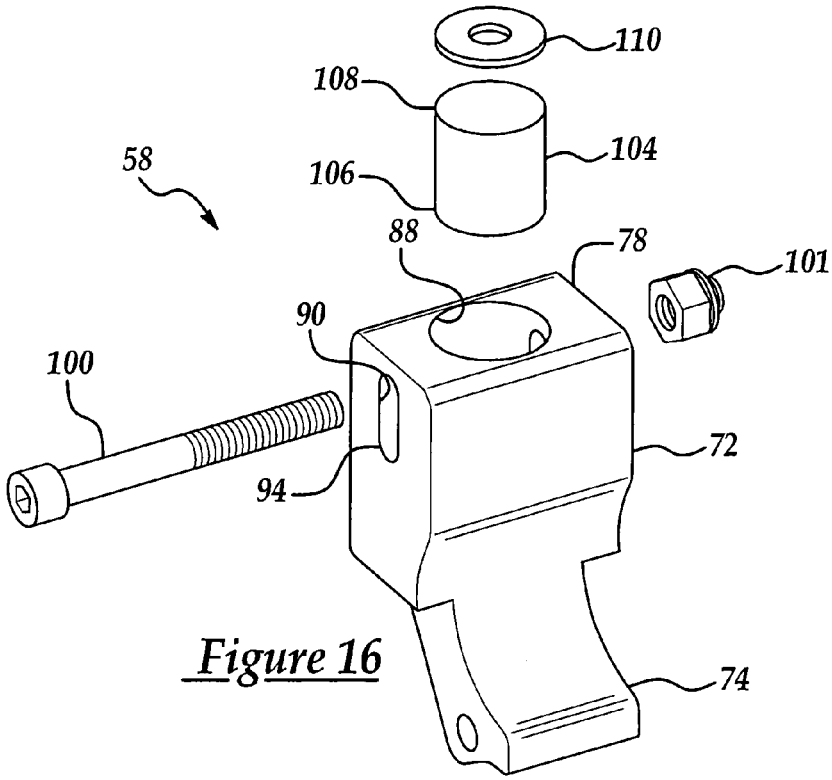
FIG. 16 is another exploded perspective view of the alternative embodiment of the pivot link.

In an alternative embodiment of the present invention, as illustrated in FIGS. 14 and 16, the pivot link 62 includes a bar 104, having a cylindrical shape. The bar 104 is made from a resilient material, such as vulcanized rubber or an elastomer. The bar 104 includes first and second ends 106, 108, wherein the second end 108 further includes a cavity (not shown) defined therewithin to receive a washer 110 embedded within the cavity and formed from a metal. The washer 110 contacts the bolt 100. The bar 104 is positioned within the pocket 88 extending internally from the bottom end 76 towards the top end 74 of the body 72.

The bolt 100, slided through the slots 90, 92, is positioned below the bar 104 to keep the bar 104 within the pocket 88. In the close mode of operation of a brake assembly, the bolt 100 travels within the slots 90, 92 from the first end 94 to the second end 96, compressing the bar 104. In the open mode of operation of the brake assembly 20, the bolt 100 travels from the second end 96 to the first end 94 releasing the bar 104 within the pocket 88.

Figure 17:
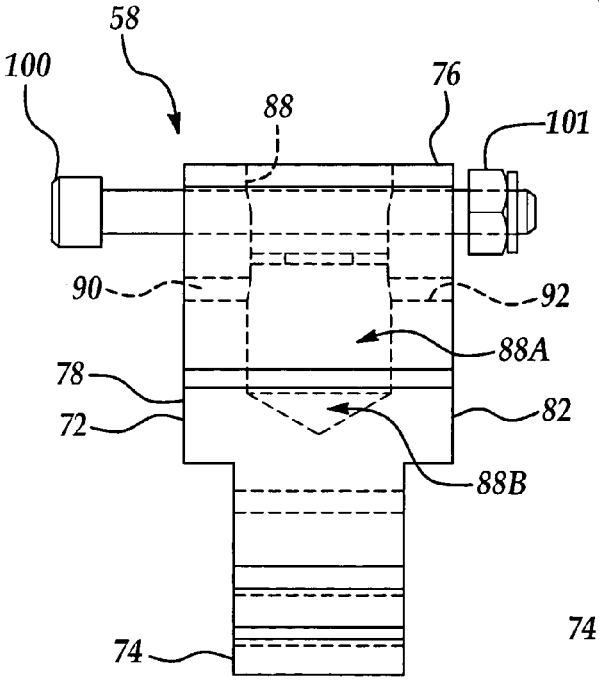
FIG. 17 is a sectional front elevational of the alternative pivot link.
Figure 18:
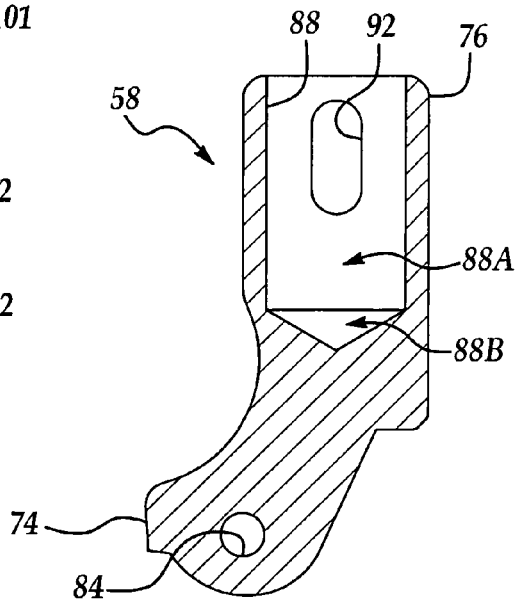
FIG. 18 is a sectional side elevational view of the alternative pivot link.

In one aspect of the present invention (shown in FIGS. 17 and 18), the pocket 88 includes a first portion 88A and a second portion 88B. The bar 104 is located primarily within the first portion 88A when the sheet bending brake 20 is in the open position. When the brake 20 is closed, the bar 104 is compressed, as described above and a deformed portion of the bar 104 may be compressed within the second portion 88B.

In one embodiment, the first portion 88A has a cylindrical shape and the second portion 88B has a conical shape. However, it should be noted that the present invention is not limited to any particular shape.

As appreciated by those skilled in the art, the bolt 100 that adjusts the bar 104 between the open and the clamped positions of the brake assembly 20, as shown in FIGS. 8 and 9, makes the pivot link 62 self-adjustable that eliminates the need of adjustment by the operator.

Obviously, many modifications and variations of the present invention are possible in light of the above teachings. The invention may be practiced otherwise than as specifically described within the scope of the appended claims.

What is claimed is:

1. A sheet bending brake for securing a work piece, comprising:

a clamping member having a lower leg extending therefrom;

a pivoting arm pivotally supported by and extending from the clamping member to define a clamping area with the lower leg;

a guide mechanism reacting between the clamping member and the pivoting arm for moving said pivoting arm between an open position and a closed position, the guide mechanism having pivot link with a body, the body having a top end and a bottom end and first and second side walls, the top end being rotatably coupled to the clamping member, the bottom end being rotatably coupled to the pivoting arm and having a pocket extending toward the top end and a pair of slots extending from one side wall to the other side wall, the pair of slots each having a first end portion and a spaced and opposed second end portion, the pocket intersecting the pair of slots;

a spring mechanism located within the pocket and being coupled between the guide mechanism and the pivoting arm; and a bolt threaded through an aperture in the pivoting arm and the pair of slots, the spring mechanism being located between the bolt and an end of the pocket, wherein the bolt is selectively operable to travel between the first end portion and the second end portion of the pair of slots so as to permit the compression and decompression of the spring mechanism.

2. A sheet bending brake, as set forth in claim 1, wherein the spring mechanism includes a spring.

3. A sheet bending brake, as set forth in claim 1, wherein the spring mechanism includes a bar composed of a resilient material.

4. A sheet bending brake, as set forth in claim 1, the pocket having a first portion and a second portion.

5. A sheet bending brake, as set forth in claim 4, the spring mechanism being located primarily within the first portion when the brake is in the open position.

6. A sheet bending brake, as set forth in claim 5, the spring mechanism being compressed when the brake is in the closed position, a deformed portion of the spring mechanism being located within the second portion.

7. A sheet bending brake, as set forth in claim 4, the first portion having a cylindrical shape.

8. A sheet bending brake, as set forth in claim 4, the second portion having a conical shape.

9. A sheet bending brake for securing a work piece, comprising:

a guide mechanism operably associated with the sheet bending brake, the brake including a clamping member having a lower leg extending therefrom, a pivoting arm, the pivoting arm being pivotally supported by and extending from the clamping member to define a clamping area with the lower leg, the guide mechanism reacting between the clamping member and the pivoting arm for moving the pivoting arm between an open position and a closed position;

a pivot link having a body, the body having a top end and a bottom end and first and second side walls, the top end having an aperture extending from the first side wall to the second side wall, the bottom end having a pocket extending toward the top end and a pair of slots extending from one side wall to the other side wall, the pair of slots each having a first end portion and a spaced and opposed second end portion, the pocket intersecting the pair of slots;

a spring mechanism located within the pocket;

a rod inserted through the pair of slots, the spring mechanism being located between the rod and an end of the pocket; and wherein the rod is threaded through an aperture in the pivoting arm and the pair of slots, wherein the rod is selectively operable to travel between the first end portion and the second end portion of the pair of slots so as to permit the compression and decompression of the spring mechanism.

10. A sheet bending brake, as set forth in claim 9, wherein the spring mechanism includes a spring.

11. A sheet bending brake, as set forth in claim 9, wherein the spring mechanism includes a bar composed of a resilient material.

12. A sheet bending brake, as set forth in claim 9, the pocket having a first portion and a second portion.

13. A sheet bending brake, as set forth in claim 12, the spring mechanism being located primarily within the first portion when the brake is in the open position.

14. A sheet bending brake, as set forth in claim 13, the spring mechanism being compressed when the brake is in the closed position, a deformed portion of the spring mechanism being located within the second portion.

15. A sheet bending brake, as set forth in claim 12, the first portion having a cylindrical shape.

16. A sheet bending brake, as set forth in claim 12, the second portion having a conical shape.

* * * * *